US012352285B2

(12) United States Patent
Ma et al.

(10) Patent No.: US 12,352,285 B2
(45) Date of Patent: Jul. 8, 2025

(54) IMPELLER FOR HEAT DISSIPATION FAN, HEAT DISSIPATION FAN HAVING THE SAME AND ELECTRONIC DEVICE

(71) Applicants: CHAMP TECH OPTICAL (FOSHAN) CORPORATION, Foshan (CN); Foxconn Technology Co., Ltd., New Taipei (TW)

(72) Inventors: Xiao-Guang Ma, Foshan (CN); Zheng Luo, Foshan (CN); Yung-Ping Lin, New Taipei (TW); Peng-Fei Mai, Foshan (CN)

(73) Assignees: CHAMP TECH OPTICAL (FOSHAN) CORPORATION, Foshan (CN); Foxconn Technology Co., Ltd., New Taipei (TW)

( * ) Notice: Subject to any disclaimer, the term of this patent is extended or adjusted under 35 U.S.C. 154(b) by 0 days.

(21) Appl. No.: 18/539,732

(22) Filed: Dec. 14, 2023

(65) Prior Publication Data

US 2024/0410388 A1 Dec. 12, 2024

(30) Foreign Application Priority Data

Jun. 7, 2023 (CN) ..... 202310675582.2

(51) Int. Cl.
*F04D 29/38* (2006.01)
*F04D 19/00* (2006.01)
*F04D 29/32* (2006.01)

(52) U.S. Cl.
CPC ..... *F04D 29/384* (2013.01); *F04D 19/002* (2013.01); *F04D 29/325* (2013.01)

(58) Field of Classification Search
CPC .... F04D 29/384; F04D 29/329; F04D 29/666; F04D 29/681; F04D 25/08; F04D 29/002; F04D 29/34; F04D 29/388; F04D 29/66; F05D 2240/304; F05D 2240/307
See application file for complete search history.

(56) References Cited

U.S. PATENT DOCUMENTS 4,930,990 A * 6/1990 Brackett ..... F04D 29/384 416/223 R
6,994,523 B2 * 2/2006 Eguchi ..... F04D 29/384 416/235

(Continued)

FOREIGN PATENT DOCUMENTS

| | | |
|---|---|---|
| CN | 102691674 A | 9/2012 |
| EP | 0766791 B1 | 6/2002 |
| TW | I754571 B | 2/2022 |

*Primary Examiner* — Anthony Ayala Delgado
(74) *Attorney, Agent, or Firm* — ScienBiziP, P.C.

(57) ABSTRACT

An impeller for heat dissipation fan includes a hub and blades, the blades are arranged around the hub. An inlet side and an outlet side, in an axial direction of the impeller, the inlet side is defined at an end of the impeller, the outlet side is defined at another end of the impeller. Each of the blades comprises a windward surface and a leeward surface opposite to the windward surface, the side of the blade back from the hub is an outer edge, and the side of the blade corresponding to the inlet side is a front edge, a first connection region is connected between the outer edge and the front edge, and the first connection region is arc-shaped where the windward surface connected to the leeward surface.

20 Claims, 12 Drawing Sheets

(56) References Cited

U.S. PATENT DOCUMENTS

| | | | | |
|---|---|---|---|---|
| 8,770,943 | B2 * | 7/2014 | Ishihara | F04D 29/384<br>416/235 |
| 2016/0201689 | A1 * | 7/2016 | Inada | F04D 29/325<br>415/209.3 |
| 2022/0145899 | A1 * | 5/2022 | Chiu | F04D 29/34 |
| 2022/0307519 | A1 * | 9/2022 | Luo | F04D 29/329 |

* cited by examiner

IMPELLER FOR HEAT DISSIPATION FAN, HEAT DISSIPATION FAN HAVING THE SAME AND ELECTRONIC DEVICE

FIELD

The subject matter herein generally relates to field of heat dissipation device, and more particularly, to an impeller for heat dissipation fan, a heat dissipation fan having the impeller, and electronic device.

BACKGROUND

When a fan rotates, a windward surface of each blade will be subjected to wind pressure. Some of the blades are subjected to higher wind pressure and wind resistance, creating an environment where vortex between the blades is easily generated. The vortex can disrupt airflow out of the blades badly, thus increase the noise. Excessive wind resistance increases airflow friction from the blades, thus reduce the efficiency.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding portions throughout the several views.

Figure 1:
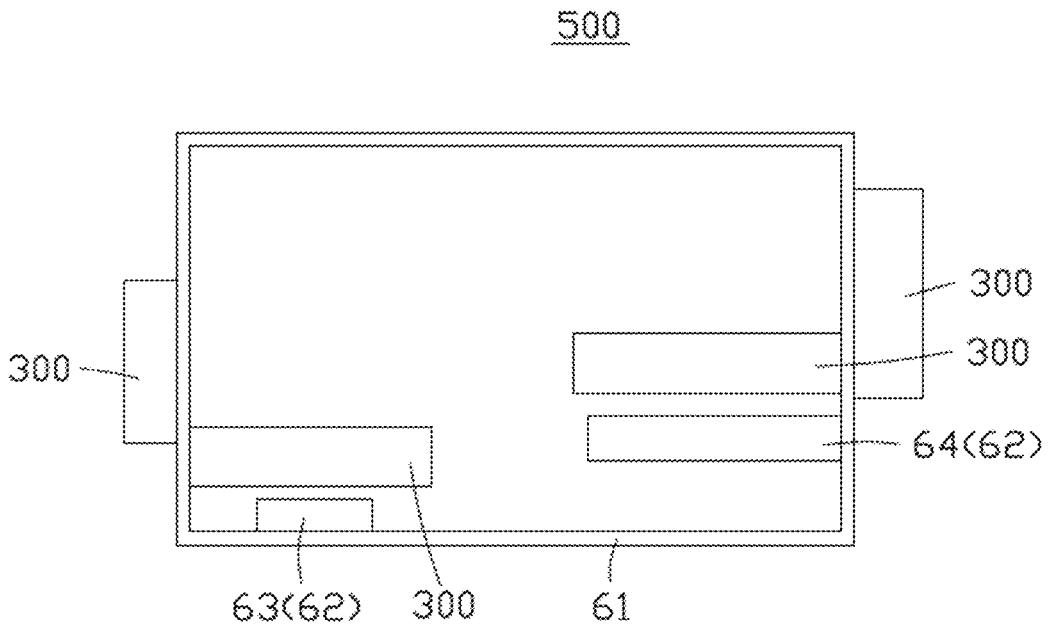
FIG. 1 is a diagrammatic view of an electronic device according to an embodiment of the present disclosure.

DESCRIPTION OF MAIN COMPONENTS OR ELEMENTS impeller 100;
hub 10;
central receiving groove 11;
stiffener 12;
vent 13;
closed side 14;
Open side 15;
blade 20;
body 21;

Body part 211;
protruding part 212;
tilt part 22;
windward surface 23;
convex surface 231;
leeward surface 24;
concave surface 241;
front edge 25;
back edge 26;
outer edge 27;
inner edge 28;
transition surface 29;
heat dissipation fan 300;
base 41;
shaft 42;
drive unit 43;
electronic device 500;
Housing 61;
electronic component 62;
central processing unit 63;
graphics Processing Unit 64;
circumferential direction Y1;
radial direction Y2;
axial Y3;
The first arc length S1;
The S arc length S2;
inlet side K1;
outlet side K2;
first connection region Q1;
second connection region Q2;
third connection region Q3;
fourth connection region Q4.

DETAILED DESCRIPTION

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts may be exaggerated to better illustrate details and features of the present disclosure.

The disclosure is illustrated by way of example and not by way of limitation in the figures of the accompanying drawings, in which like references indicate similar elements. It should be noted that references to "an" or "one" embodiment in this disclosure are not necessarily to the same embodiment, and such references mean "at least one."

The term "comprising," when utilized, means "including, but not necessarily limited to"; it specifically indicates open-ended inclusion or membership in the so-described combination, group, series, and the like.

Referring to FIG. 1, an embodiment of an electronic device (electronic device 500) is provided. The electronic device 500 includes a housing 61, electronic component 62, and a heat dissipation fan 300. The electronic component 62 and the heat dissipation fan 300 are arranged in the housing 61. The heat dissipation fan 300 is used to dissipate heat from the electronic component 62 or the housing 61. In one embodiment, the electronic device 500 may be a computer or a server. The electronic component 62 may be a central processing unit (CPU) 63, an (Graphics Processing Unit) GPU 64, when the electronic component 62 operates, heat generated by the electronic component 62 is conducted to the housing 61.

The heat dissipation fan 300 can be directly located on an outside of the housing 61 and set corresponding to the housing 61 to dissipate the heat of the housing 61 to improve the overall heat dissipation efficiency of the electronic device 500.

The heat dissipation fan 300 may also be provided inside of the housing 61 and corresponding to the electronic component 62 to dissipate heat from the electronic component 62.

Figure 2:
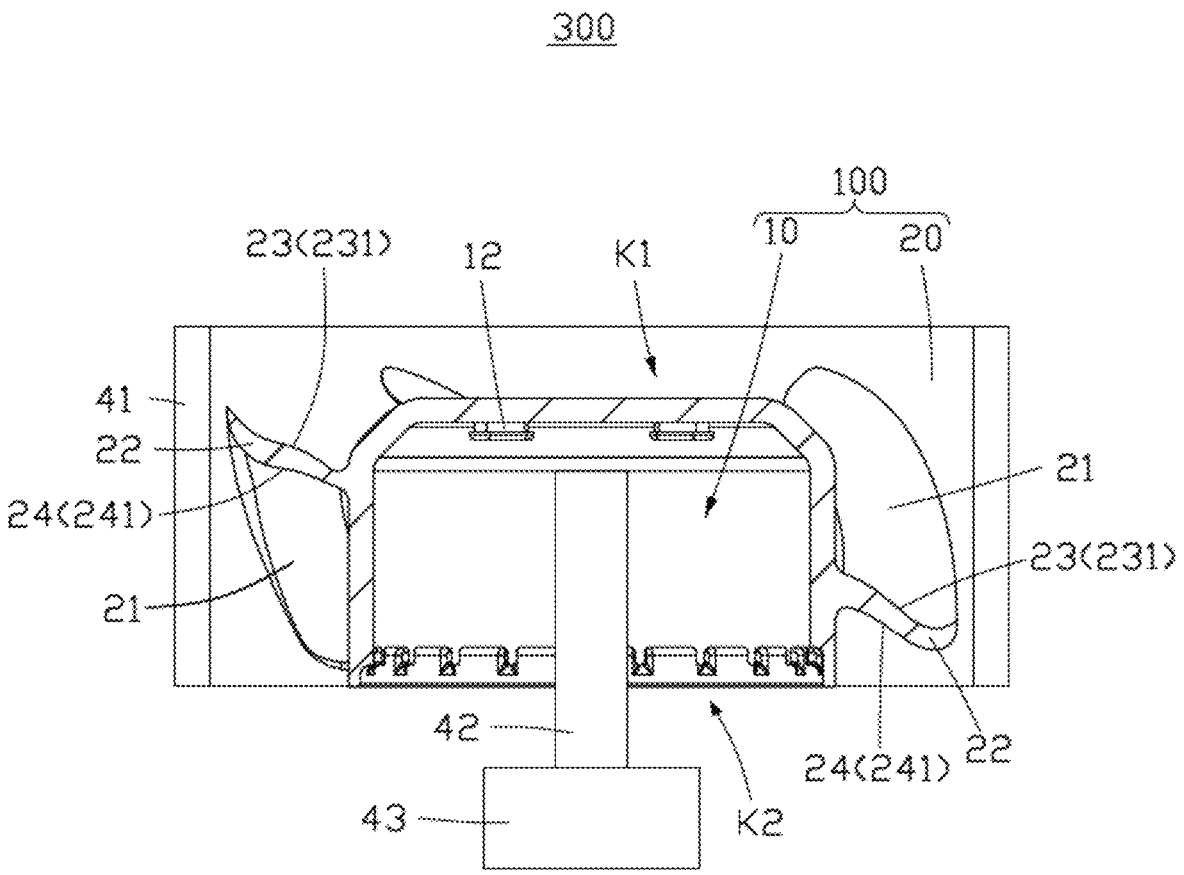
FIG. 2 is a diagrammatic view of a heat dissipation fan of the electronic device of FIG. 1.

Referring to FIG. 2, the heat dissipation fan 300 includes a base 41 and an impeller 100. The impeller 100 is provided in the base 41. The impeller 100 includes a shaft 42 and a drive unit 43. The shaft 42 is connected between the impeller 100 and the drive unit 43. The drive unit 43 being used to output torque to rotate the shaft 42 and the impeller 100. The impeller 100 is capable of driving air to generate airflow when it rotates, the airflow is capable of dissipating heat from the housing 61 or the electronic component 62 of the electronic device 500.

Referring to FIG. 2, the impeller 100 includes a hub 10 and blades 20. The hub 10 has a closed side 14 and an open side 15. The hub 10 defines a central receiving groove 11, an opening of the central receiving groove 11 is provided at the open side 15. The shaft 42 is provided in the central receiving groove 11. One end of the shaft 42 is connected to the drive unit 43, the other end of the shaft 42 is connected to the closed side 14. The drive unit 43 rotates the hub 10 and rotates the blades 20 by driving the shaft 42.

In one embodiment, referring to FIG. 2, the blades 20 are arranged along a circumferential direction Y1 of the hub 10. Each blade 20 includes a windward surface 23 and a leeward surface 24 opposite to the windward surface 23. The windward surface 23 is provided on a side of the blade 20 towards the closed side 14. The leeward surface 24 is provided on a side of the blade 20 towards the open side 15.

When the drive unit 43 drives the hub 10 to rotate around the shaft 42, the blades 20 are rotated. The air on the windward side 23 of the blade 20 is continuously pushed to the open side 15 of the hub 10, so that the pressure of the air on the windward surface 23 of the blade 20 decreases continuously, and the pressure of the air on the leeward surface 24 rises continuously. The closed side 14 of the hub 10 is formed as an inlet side K1 of the impeller 100, the open side 15 of the hub 10 is formed as an outlet side K2 of the impeller 100. The air pressure of the closed side 14 of the hub 10 is less than the air pressure of the air at the inlet side K1, so that the air at the outside of the closed side 14 can be replenished to the inlet side K1 continuously. The air pressure of the air at the open side 15 of the hub 10 is less than the air pressure of the air at the outlet side K2, so that the air at the outlet side K2 is replenished to the outside of the open side 15 of the hub 10 continuously, until the amount of air input to the inlet side K1 is approximately equal to the amount of air coming out of the outlet side K2, and forming a stable airflow. The airflow can dissipate and cool down the surface of the chassis 61 or the electronics 62 after passing the chassis 61 or the electronics 62.

Figure 3:
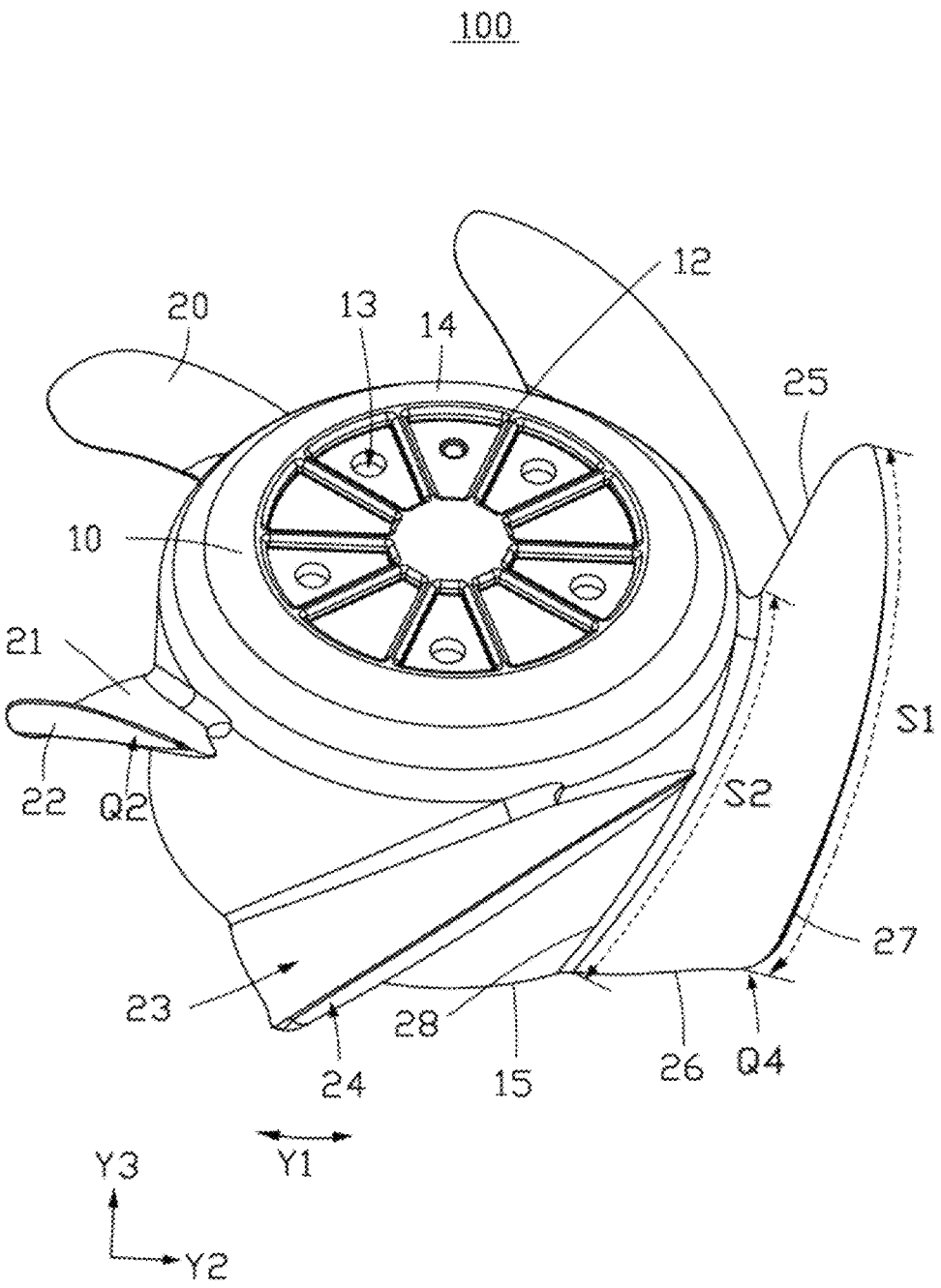
FIG. 3 is a diagrammatic view of an impeller of the heat dissipation fan of FIG. 2.
Figure 4:
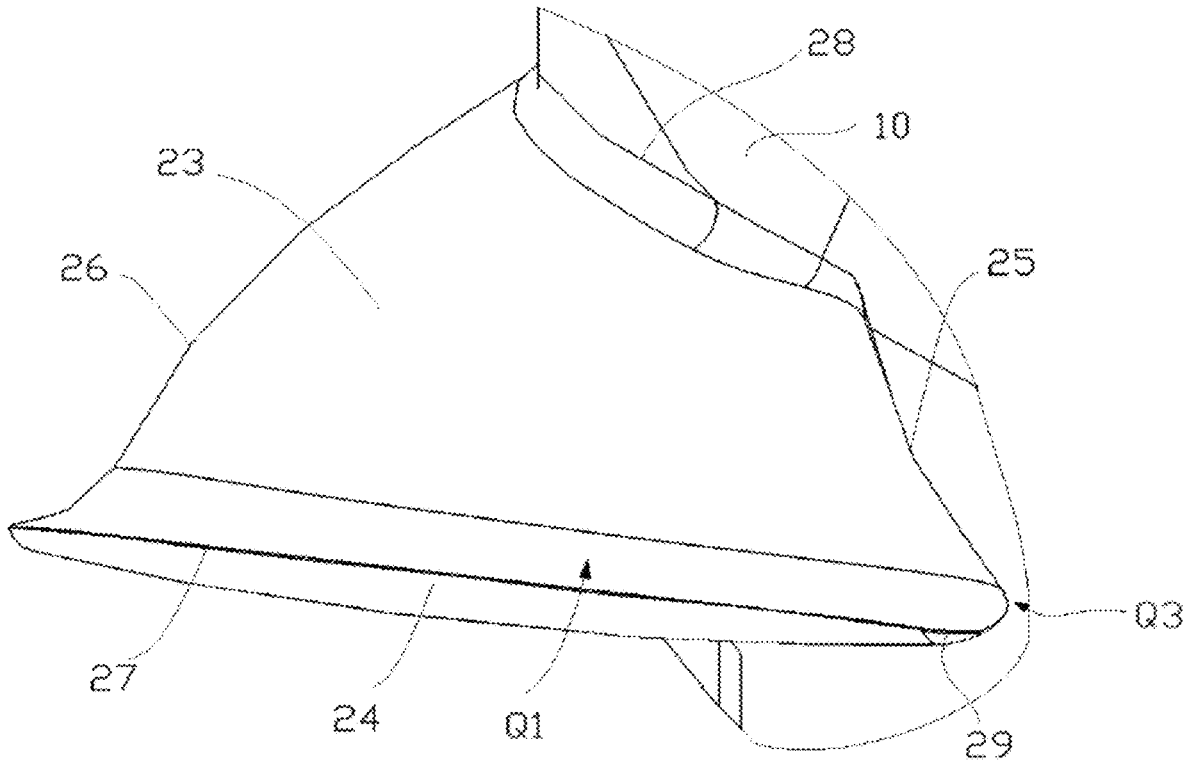
FIG. 4 is a diagrammatic view of a localized structure of the impeller of FIG. 3.

In one embodiment, referring to FIGS. 3 and 4, each blade 20 includes a front edge 25, a back edge 26, an outer edge 27, and an inner edge 28. A side of the blade 20 which attached to the hub 10 is the inner edge 28, a side of the blade 20 which back from the hub 10 is the outer edge 27. The front edge 25 and the back edge 26 are disposed at the two ends of the hub 10 along the axial direction Y3 respectively. The front edge 25 is provided in correspondence with the closed side 14 of the hub 10, the back edge 26 is provided in correspondence with the open side 15 of the hub 10.

Figure 5:
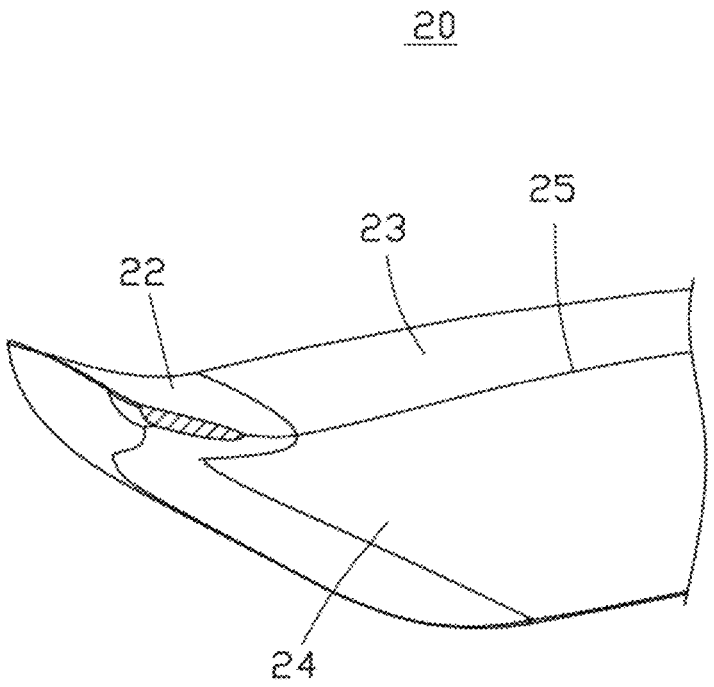
FIG. 5 is a cross-sectional view of the impeller of FIG. 3.
Figure 6:
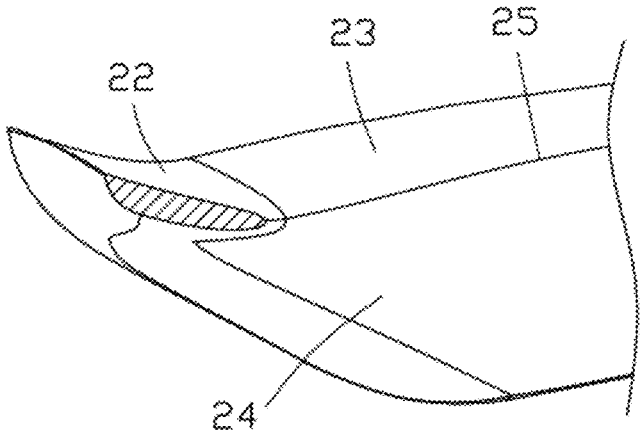
FIG. 6 is another cross-sectional view of the impeller of FIG. 3.

In one embodiment, referring to FIGS. 3, 5 and 6, a first connection region Q1 between the backwind surface 24 and the windward surface 23 is arc-shaped. The edge of the backwind surface 24 is rounded, the edge of the windward surface 23 is also rounded, the edge of the backwind surface 24 extends gradually and connects to the edge of the windward surface 23. The first connection region Q1 can be a linear or a curved surface. When the first connection region Q1 is a curved surface, one side of the curved surface connected to the edge of the backwind surface 24, the other side of the curved surface connected to the edge of the windward surface 23.

A third connection region Q3 is connected between the outer edge 27 and the front edge 25, and the third connection region Q3 is arc-shaped where the windward surface 23 connected to the leeward surface 24, the third connection region Q3 makes the edges of the blade 20 more rounded, so that the third connection region Q3 between the outer edge 27 and the front edge 25 (which corresponds to the inlet side K1 of the impeller 100) is also rounded, which reduce the resistance of the airflow when the airflow enters the blade 20 from the inlet side K1. When the airflow enters the blade 20, the third connection region Q3 can improve the air supply performance of the blade 20, improve the heat dissipation efficiency of the impeller 100, and reducing the noise generated by the airflow, which in turn improves the heat dissipation efficiency of the impeller 100, and reduces the noise generated when the airflow flows. In addition, since the edges of the blade 20 are rounded and smooth, it is not easy to cut the user, and improves the safety of picking up and placing the impeller 100 in the process of disassembling and assembling, maintenance.

In one embodiment, referring to FIG. 4, the backwind surface 24 is provided with a transition surface 29 at an edge proximate to a third connection region Q3 between the front edge 25 and the outer edge 27. The transition surface 29 forms part of the arc-shaped first connection region Q1, and ensure the streamlined shape of the blade 20.

In one embodiment, the front edge 25, the back edge 26, the outer edge 27 are formed by the junction of the backwind surface 24 and the windward surface 23.

Figure 8:
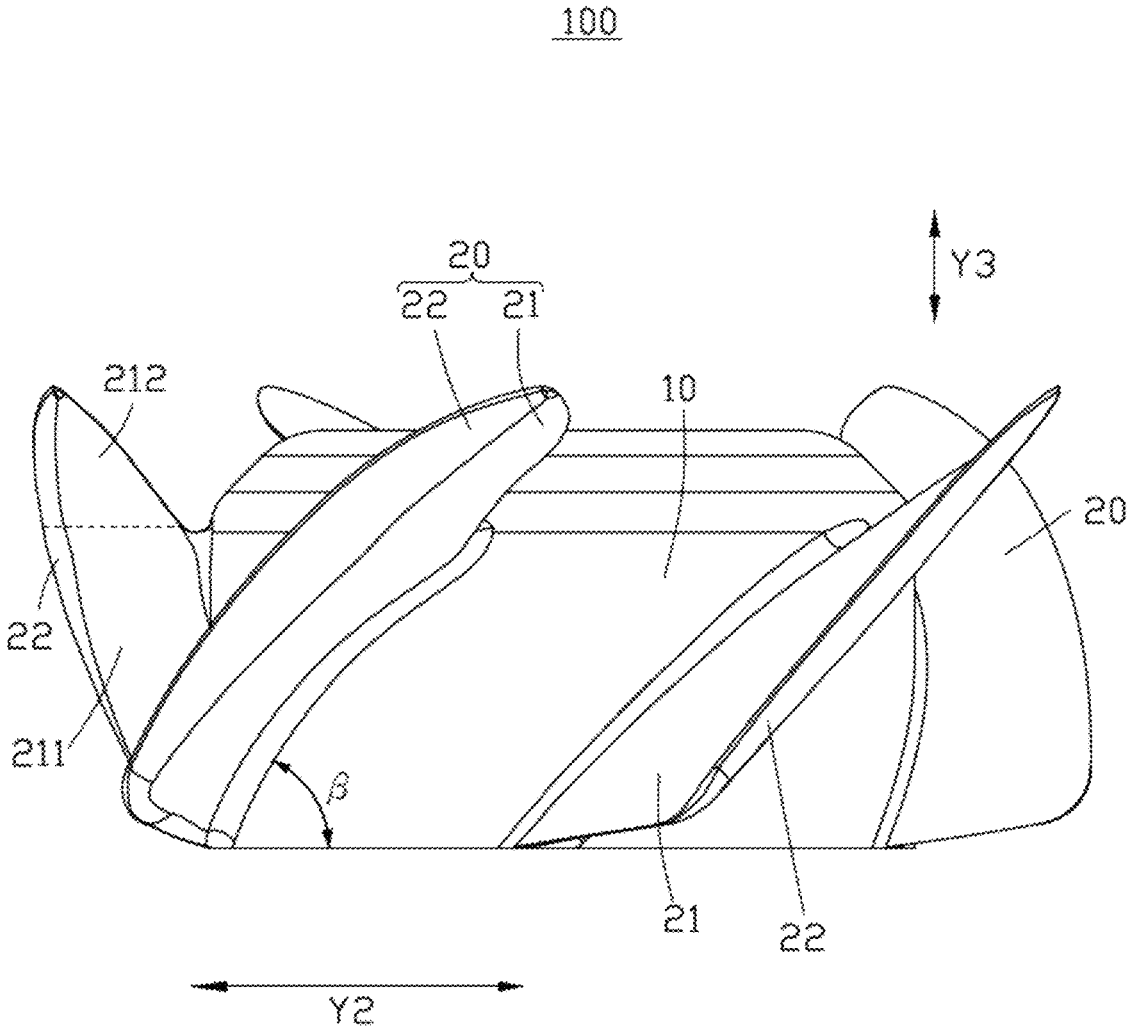
FIG. 8 is a side view of the impeller in FIG. 3.

In one embodiment, referring to FIG. 8, each blade 20 is partially spiral, and arranged along the direction of the hub 10. The angle between the inner edge 28 and a cross-section of the body 21 in the radial direction Y2 of the body 21 is β, $20° \leq \beta \leq 45°$. This increases the contact area between the blade 20 and the air, thereby increasing the amount of airflow and the pressure difference between the windward side 23 and the leeward side 24. The inner edge 28 and the outer edge 27 are in an arc, thus there is an arc in each of two dimensions, meaning that there is an arc from inner the edge 28 to the outer edge 27 and an arc from the front edge 25 to the back edge 26. This reduces friction between air and the blade 20, thereby increasing the amount of airflow and the heat dissipation performance.

Figure 7:
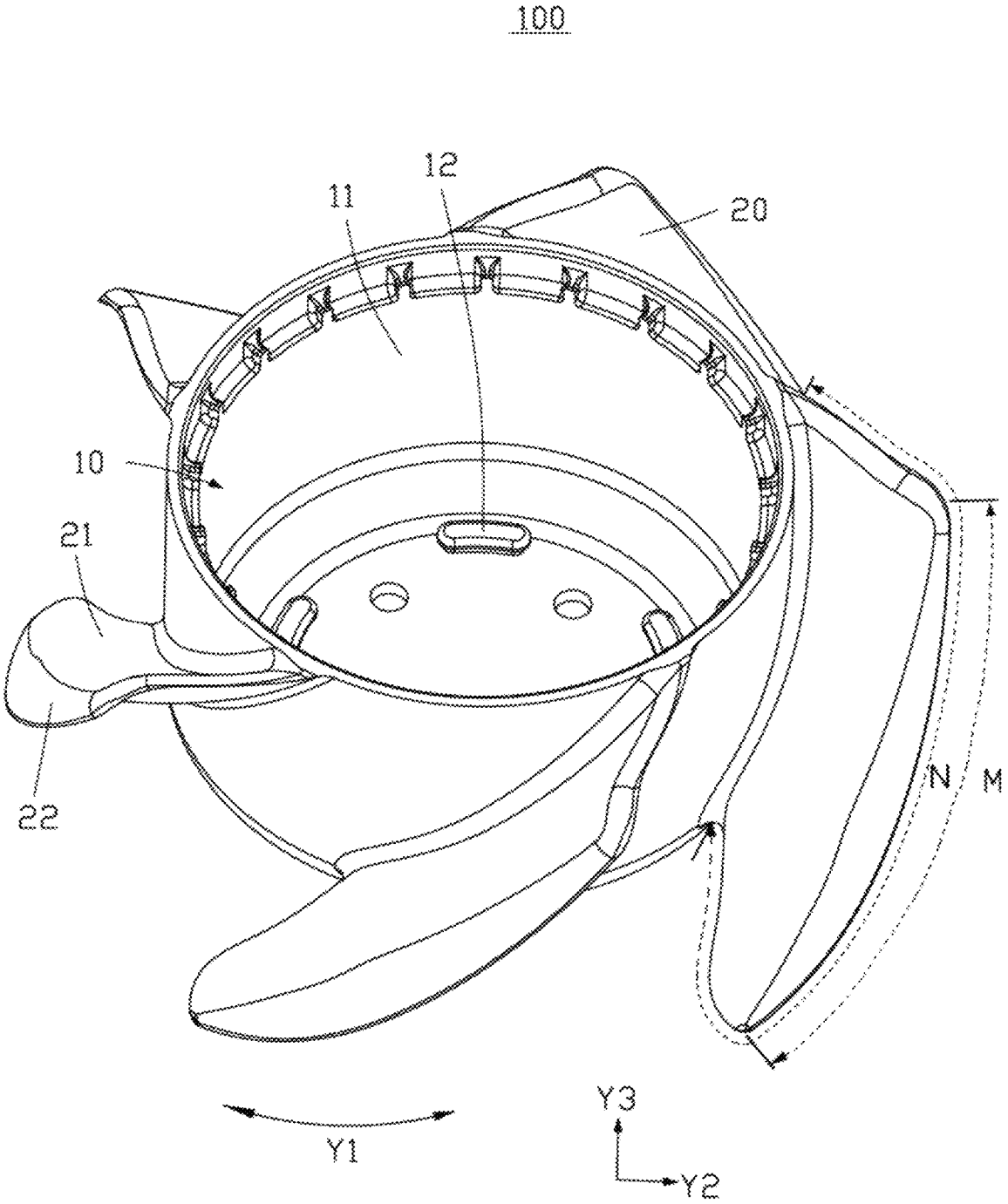
FIG. 7 is a diagrammatic view of the impeller in FIG. 3, shown from a different aspect.

In one embodiment, referring to FIGS. 3 and 7, the third connection region Q3 between the front edge 25 and the outer edge 27 is arc-shaped, a fourth connection region Q4 between the back edge 26 and the outer edge 27 is arc-shaped. The third connection region Q3 and the fourth connection region Q4 reduce drag of the high-speed rotating blade 20, increase the amount of airflow and increase the performance of the heat dissipation fan 300, and facilitate the molding of the blade 20.

In one embodiment, referring to FIG. 3, a first arc length S1 of the outer edge 27 is greater than a second arc length S2 of the inner edge 28. This improve space utilization between hub 10 and base 41, and increase area of the windward side 23.

In one embodiment, referring to FIG. 7, the sum of the lengths of the front edge 25, back edge 26, and outer edge 27 is N, the length of the outer edge 27 is M, and a ratio of M to N is in a range of 70% to 90%. For example, M/N may be any one of 70%, 71%, 72%, 73%, 74%, 75%, 76%, 77%, 78%, 79%, 80%, 81%, 82%, 83%, 84%, 85%, 86%, 87%, 88%, 89%, 90%.

Figure 9:
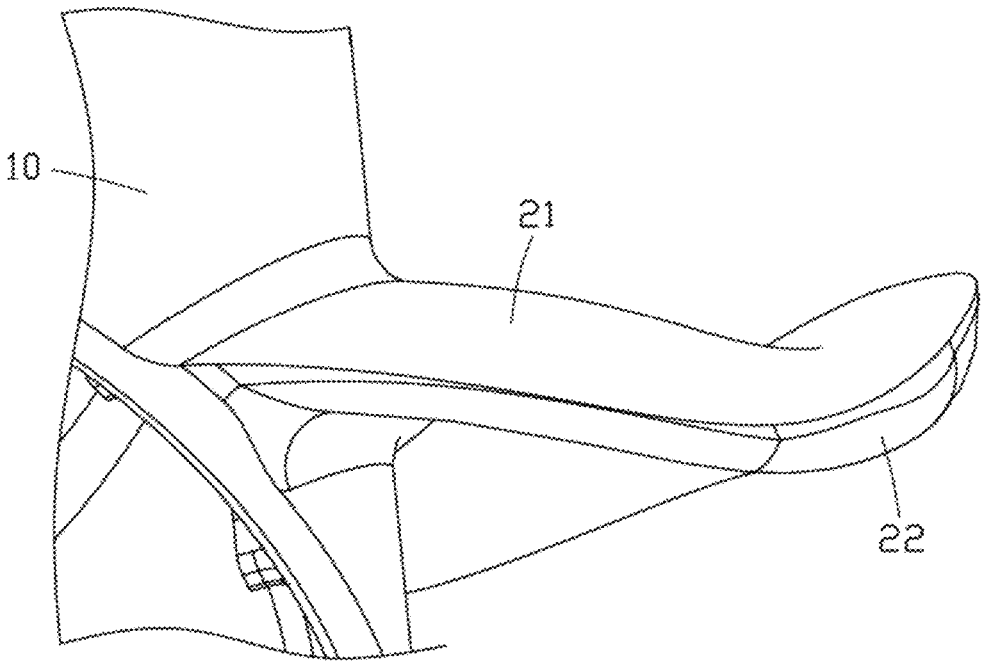
FIG. 9 is a diagrammatic view of the impeller in FIG. 4, shown from a different aspect.

In one embodiment, referring to FIGS. 2 and 9, each of the blades 20 comprises a body 21 and a tilt part 22. The tilt part 22 is connected to the side of the body 21 furthest away from the hub 10, the tilt part 22 is bent to the side of the windward surface 23 relative to the body 21, a second connection region Q2 between the body 21 and the tilt part 22 is arc-shaped. Thus, the windward side 23 is formed as a smooth arc curved surface. The extension direction of the windward side 23 is in the same direction as the flow direction of the airflow, the windward side 23 can guide the flow of the airflow from the inlet side K1 to the outlet side K2, reducing the frictional resistance between air and the windward side 23, reducing the pressure on the windward side 23 and the backwind side 24, thereby increasing the airflow and the cooling efficiency of the heat dissipation fan 300, and reducing the vortex and the noise. The tilt part 22 increase the area of the windward surface 23, improve the flow of air, and the cooling efficiency.

Figure 10:
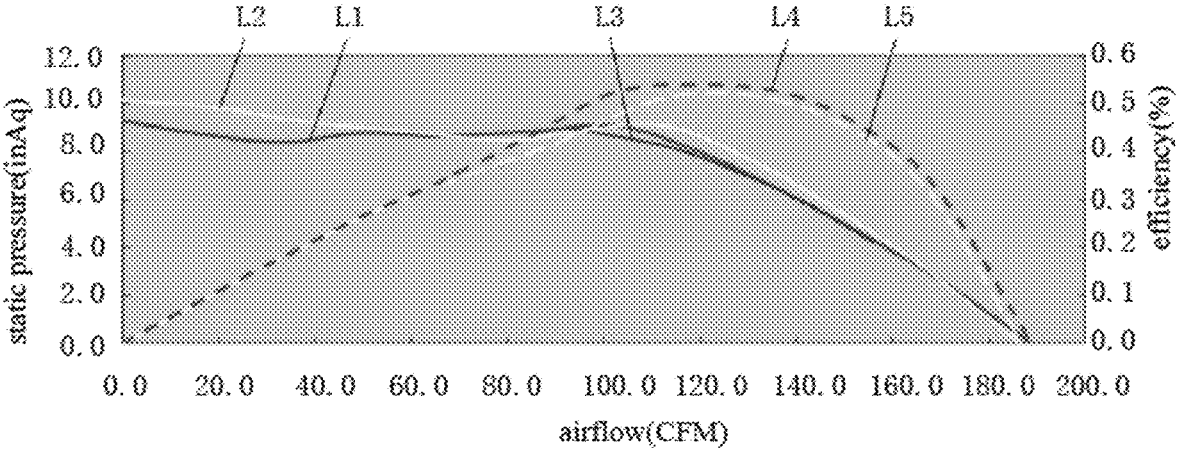
FIG. 10 is a schematic diagram of airflow rate versus static pressure and airflow rate versus efficiency of the impeller of FIG. 3; and a comparative example.

Referring to FIG. 10, the horizontal axis is the airflow flow rate, the longitudinal axis on the left side is the static pressure, the longitudinal axis on the right side is the efficiency. The blade of a comparative example is not provided with the tilt part 22. Referring to FIG. 10, the curve L1 is the static pressure versus airflow flow rate of the heat dissipation fan 300 in the present disclosure, the curve L2 is the static pressure versus airflow flow rate in the comparative example, the curve L3 is the standard curve of static pressure versus airflow flow rate. The curve L4 is a curve of efficiency versus airflow flow rate of the heat dissipation fan 300 in the present disclosure, the curve L5 is a curve of efficiency versus airflow flow rate of the comparative example. Referring to FIG. 10, the efficiency of the heat dissipation fan 300 of the present disclosure is substantially greater than the comparative example, the static pressure of the heat dissipation fan 300 of the present disclosure is greater than the comparative example over most of the range of the airflow rate. The maximum efficiency of the heat dissipation fan 300 of the present disclosure is 54%, the maximum efficiency of the comparative example is 52%.

Figure 11:
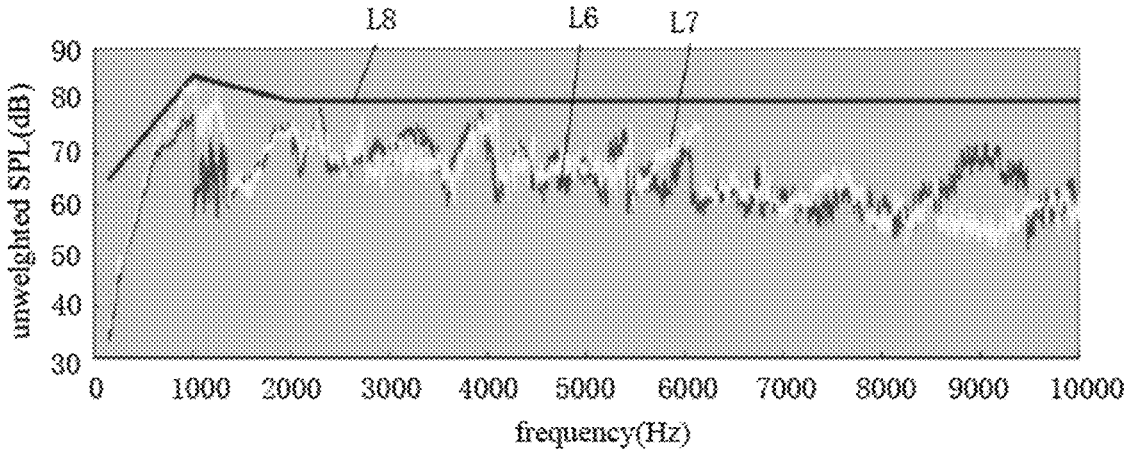
FIG. 11 is a schematic diagram of noise versus frequency of the impeller of FIG. 3; and a comparative example.

Referring to FIG. 11, the horizontal axis is frequency, the vertical coordinate is noise, curve L6 is a curve of noise versus frequency for the heat dissipation fan 300 of the present disclosure, curve L7 is a curve of noise versus frequency for the comparative example, and curve L8 is a standard curve of noise versus frequency. Referring to FIG. 11, the noise of the heat dissipation fan 300 of the present disclosure is lower than the noise of the comparative example over most ranges of frequency. The noise of the heat dissipation fan 300 of the present disclosure is 84 dB and the noise of the comparative example is 87.5 dB.

Thus, the efficiency of operation of the heat dissipation fan 300 of the present disclosure is improved by more than 2% relative to the efficiency of operation of the known heat dissipation fan 300. According to the prevalent energy consumption of the heat dissipation fan 300, the power can be reduced by about 4 W to 10 W, and the noise can be reduced by about 3 dBA to 4 dBA. Since the electronic device 500 runs 24 hours during operation uninterruptedly, and the electronic device 500 configured with cooling fans 300, such as each electronic device 500 is configured with six cooling fans 300. Thus the power is able to reduce from 24 W to 60 W. Account the fact that the electronic device 500 runs with centralized units typically, thus improve the cooling capacity and the noise, reduce the energy consumption, and save energy.

Figure 12:
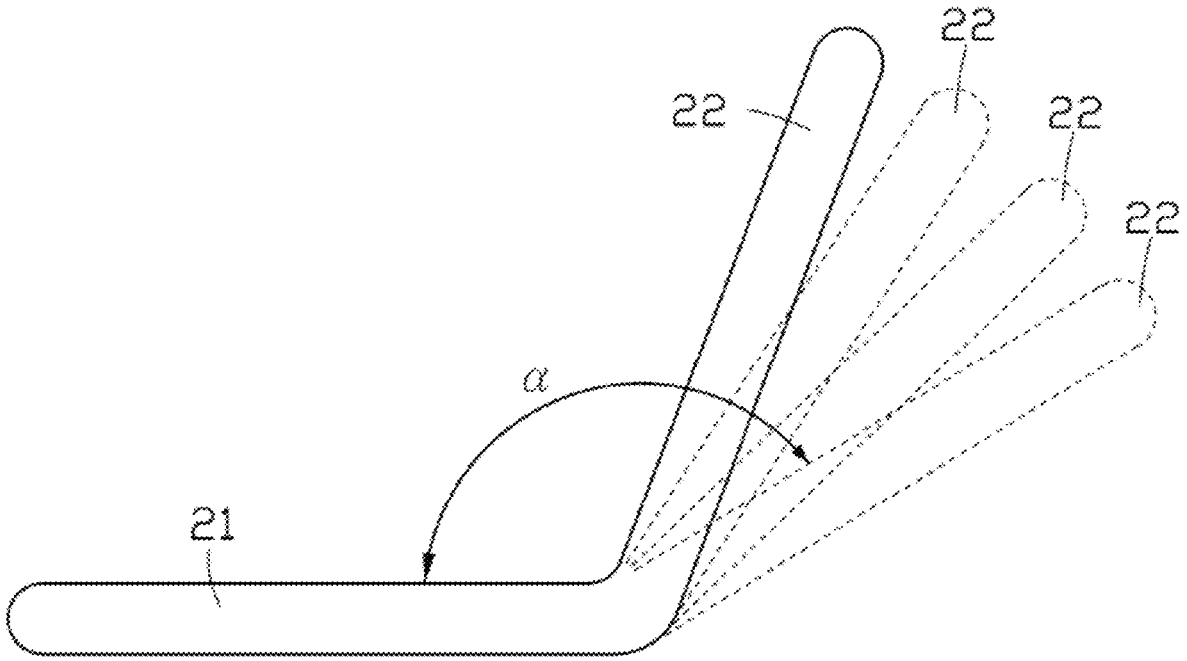
FIG. 12 is a diagrammatic view of a body and a tilt part of the impeller of FIG. 3.

In one embodiment, referring to FIG. 12, an angle between the tilt part 22 and the body 21 is α, 110°≤α≤165°. When a is more than 1650, the windward surface 23 cannot direct airflow better. When a is between 90° and 110°, which may increase the resistance to the flow of the airflow. When a is less than 90°, which may cause poor airflow. Therefore, limiting the a to between 110° and 165° ensures the guiding effect on the airflow, and friction between the airflow and the blade 20 reduces, the wind resistance reduces.

In one embodiment, a may be any one of 110°, 111°, 110°, 111°, 112°, 113°, 114°, 115°, 116°, 117°, 118°, 119°, 120°, 121°, 122°, 123°, 124°, 125°, 126°, 127°, 128°, 129°, 130°, 131°, 132°, 133°, 134°, 135°, 136°, 137°, 138°, 139°, 140°, 141°, 142°, 143°, 144°, 145°, 146°, 147°, 148°, 149°, 150°, 151°, 152°, 153°, 154°, 155°, 156°, 157°, 158°, 159°, 160°, 161°, 162°, 163°, 164°, 165°.

In one embodiment, referring to FIG. 2, The windward surface 23 is convex surface 231, and the leeward surface 24 is concave surface 241, the blade 20 has a circular arc shape in cross-section. This increases the contact area of the blade 20 with the air, increase the flow rate of the airflow formed when the blades 20 rotates. The convex surface 231 is that the windward surface 23 is convex outwardly in a thickness of the blade 20 in a direction departing from the leeward surface 24. The concave surface 241 is that the leeward surface 24 is concave inwardly along the thickness of the blade 20 in a direction proximate to the windward surface 23. In other embodiments, the windward surface 23 is concaved, and the leeward surface 24 is convex.

In one embodiment, referring to FIG. 2, includes a body part 211 and a protruding part 212. The body part 211 is connected to the hub 10, the protruding part 212 is connected to the body part 211 and overhangs with respect to the hub 10. The front edge 25 is arranged on the protruding part 212, the tilt part 22 is bent and connected to the body part 211 and the protruding part 212. This utilizes space on the outside of the hub 10, increase the area of the windward surface 23. Thus reduce the wind resistance of the airflow, reduce the pressure difference of the heat dissipation fan 300, increase the cooling efficiency of the heat dissipation fan 300, reduce any vortex and noise generated.

In one embodiment, the front edge 25 is formed by one edge of the tilt part 22 and the edge of the protruding portion 212.

In one embodiment, referring to FIG. 3, the hub 10 includes stiffeners 12, the stiffeners 12 is arranged on the inner face of the closed side 14 or the outer side of the closed side 14. Thus reduce the deformation of blade 20 when rotating at high speed, and increase the stability of the heat dissipation fan 300.

In one embodiment, referring to FIG. 3, the hub 10 defines vents 13. The vents 13 penetrate the bottom of the central receiving groove 11, so the central receiving groove 11 communicates with an outer environment. The vents 40 are evenly arranged around the shaft 42. The vents 13 are used for transferring heat from the central receiving groove 11 to the outer environment, thus enhance the heat dissipation effect of the heat dissipation fan 300.

It is to be understood, even though information and advantages of the present embodiments have been set forth in the foregoing description, together with details of the structures and functions of the present embodiments, the disclosure is illustrative only; changes may be made in detail, especially in matters of shape, size, and arrangement of parts within the principles of the present embodiments to the full extent indicated by the plain meaning of the terms in which the appended claims are expressed.

What is claimed is:

1. An impeller for heat dissipation fan comprising:

an inlet side and an outlet side, in an axial direction of the impeller, the inlet side is defined at an end of the impeller, the outlet side is defined at another end of the impeller; and a hub; and blades, arranged around and connected to the hub; each of the blades comprises a windward surface, a leeward surface opposite to the windward surface, an outer edge, a front edge, and a first connection region and a third connection region, wherein the outer edge is a side of the blade furthest from the hub, and the front edge is a side of the blade corresponding to the inlet side of the impeller, the first connection region is arranged between the leeward surface and the windward surface, the first connection region is arc-shaped, the third connection region is connected between the outer edge and the front edge, and the third connection region is arc-shaped where the windward surface connected to the leeward surface.

2. The impeller of claim 1, wherein each of the blades further comprises a body, a tilt part, and a second connection region; the tilt part is connected to the side of the body furthest away from the hub, the tilt part is bent to a side of the windward surface relative to the body, the second connection region between the body and the tilt part is arc-shaped.

3. The impeller of claim 2, wherein an angle defined between the tilt part and the body is $\alpha$, $110° \leq \alpha \leq 165°$.

4. The impeller of claim 3, wherein $120° \leq \alpha \leq 140°$.

5. The impeller of claim 2, wherein the body further comprises a body part and a protruding part; the body part is connected to the hub, the protruding part is connected to the body part, and the protruding part overhangs with respect to the hub, the tilt part is bent, and the tilt part is connected to the body part and the protruding part.

6. The impeller of claim 1, wherein the windward surface is convex, and the leeward surface is concaved.

7. The impeller of claim 1, wherein each of the blades is part of a spiral, and arranged along a circumferential direction of the hub; a side of each of the blades which is attached to the hub is an inner edge, an arc is defined by the inner edge and the outer edge.

8. The impeller of claim 7, wherein an angle defined between the inner edge and a cross-section of the body in a radial direction is $\beta$, $20° \leq \beta \leq 45°$.

9. A heat dissipation fan comprising:

a base;

an impeller arranged in the base, the impeller comprising:

an inlet side and an outlet side, in an axial direction of the impeller, the inlet side is defined at an end of the impeller, the outlet side is defined at another end of the impeller; and a hub; and blades, arranged around and connected to the hub; each of the blades comprises a windward surface, a leeward surface opposite to the windward surface, an outer edge, a front edge, and a first connection region and a third connection region, wherein the outer edge is a side of the blade furthest from the hub, and the front edge is a side of the blade corresponding to the inlet side of the impeller, the first connection region is arranged between the leeward surface and the windward surface, the first connection region is arc-shaped, the third connection region is connected between the outer edge and the front edge, and the third connection region is arc-shaped where the windward surface connected to the leeward surface.

10. The heat dissipation fan of claim 9, wherein each of the blades further comprises a body and a tilt part, and a second connection region; the tilt part is connected to the side of the body furthest away from the hub, the tilt part is curve to the side of the windward surface relative to the body, the second connection region between the body and the tilt part is arc-shaped.

11. The heat dissipation fan of claim 10, wherein an angle defined between the tilt part and the body is $\alpha$, $110° \leq \alpha \leq 165°$.

12. The heat dissipation fan of claim 11, wherein $120° \leq \alpha \leq 140°$.

13. The heat dissipation fan of claim 10, wherein the body further comprises a body part and a protruding part; the body part is connected to the hub, the protruding part is connected to the body part, and the protruding part overhangs with respect to the hub, the tilt part is bent, and the tilt part is connected to the body part and the protruding part.

14. The heat dissipation fan of claim 9, wherein the windward surface is convex, and the leeward surface is concaved.

15. The heat dissipation fan of claim 9, wherein each of the blades is partially spiral, and the blades are arranged along a circumferential direction of the hub; a side of each of the blades which attached to the hub is an inner edge, an arc is defined by the inner edge and the outer edge are in an arc.

16. The heat dissipation fan of claim 15, wherein an angle defined between the inner edge and a cross-section of the body in a radial direction is $\beta$, $20° \leq \beta \leq 45°$.

17. An electronic device comprising:

a housing;

an electronic component arranged in the housing;

a heat dissipation fan arranged in the housing, the heat dissipation fan comprising:

a base;

an impeller arranged in the base, the impeller comprising:

an inlet side and an outlet side, in an axial direction of the impeller, the inlet side is defined at an end of the impeller, the outlet side is defined at another end of the impeller; and a hub; and blades, arranged around and connected to the hub; each of the blades comprises a windward surface, a leeward surface opposite to the windward surface, an outer edge, a front edge, and a first connection region and a third connection region, wherein the outer edge is a side of the blade furthest from the hub, and the front edge is a side of the blade corresponding to the inlet side of the impeller, the first connection region is arranged between the leeward surface and the windward surface, the first connection region is arc-shaped, the third connection region is connected between the outer edge and the front edge, and the third connection region is arc-shaped where the windward surface connected to the leeward surface.

18. The impeller of claim 1, wherein the backwind surface is provided with a transition surface at an edge proximate to the third connection region between the front edge and the outer edge.

19. The heat dissipation fan of claim 1, wherein the backwind surface is provided with a transition surface at an edge proximate to the third connection region between the front edge and the outer edge.

20. The electronic device of claim 17, wherein the backwind surface is provided with a transition surface at an edge proximate to the third connection region between the front edge and the outer edge.

* * * * *